US012146244B1

(12) United States Patent
Ashley et al.

(10) Patent No.: US 12,146,244 B1
(45) Date of Patent: Nov. 19, 2024

(54) FIRE-RESISTANT TEXTILE

(71) Applicant: Milliken & Company, Spartanburg, SC (US)

(72) Inventors: John E. Ashley, Spartanburg, SC (US); Andrew D. Child, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 18/347,004

(22) Filed: Jul. 5, 2023

Related U.S. Application Data

(60) Provisional application No. 63/391,187, filed on Jul. 21, 2022.

(51) Int. Cl.

| | |
|---|---|
| ***D03D 15/513*** | (2021.01) |
| ***D03D 15/283*** | (2021.01) |
| ***D03D 15/47*** | (2021.01) |
| ***D03D 15/533*** | (2021.01) |
| ***D03D 15/54*** | (2021.01) |
| *D03D 15/20* | (2021.01) |

(52) U.S. Cl.
CPC ..... *D03D 15/513* (2021.01); *D03D 15/283* (2021.01); *D03D 15/47* (2021.01); *D03D 15/533* (2021.01); *D03D 15/54* (2021.01); *D10B 2331/021* (2013.01); *D10B 2401/02* (2013.01); *D10B 2401/063* (2013.01); *D10B 2501/00* (2013.01)

(58) Field of Classification Search
CPC .... D03D 15/513; D03D 15/283; D03D 15/47; D03D 15/533; D03D 15/54; D10B 2331/021; D10B 2401/02; D10B 2401/063; D10B 2501/00
See application file for complete search history.

(56) References Cited

U.S. PATENT DOCUMENTS

| | | | | |
|---|---|---|---|---|
| 5,624,738 | A | 4/1997 | Barbeau | |
| 5,691,040 | A | 11/1997 | Barbeau | |
| 5,858,888 | A | 1/1999 | Underwood | |
| 5,928,971 | A | 7/1999 | Ellis | |
| 6,247,179 | B1 | 6/2001 | Underwood | |
| 6,430,754 | B1 | 8/2002 | Taylor | |
| 6,606,749 | B2 | 8/2003 | Underwood | |
| 6,624,096 | B2 | 9/2003 | Thomas | |
| 6,840,288 | B2 | 1/2005 | Zhu | |
| 6,886,184 | B2 | 5/2005 | Underwood | |
| 6,974,785 | B1 | 12/2005 | Barbeau | |
| 7,146,646 | B2 | 12/2006 | Grilliot | |
| 7,168,097 | B2 | 1/2007 | Grilliot | |
| 7,581,260 | B2 | 9/2009 | Underwood | |
| 7,854,017 | B2 | 12/2010 | Laton | |
| 7,932,194 | B2 | 4/2011 | Bader | |
| 8,071,492 | B2 | 12/2011 | Hess | |
| 8,166,743 | B2 | 5/2012 | Zhu | |
| 8,209,785 | B2 | 7/2012 | Underwood | |
| 8,516,615 | B2 | 8/2013 | Di Giovanni | |
| 8,528,120 | B2 | 9/2013 | Underwood | |
| 8,614,156 | B2 | 12/2013 | Hess | |
| 8,732,863 | B2 * | 5/2014 | Hines | C08L 33/20 2/81 |
| 8,793,814 | B1 | 8/2014 | Diianni | |
| 8,819,866 | B2 | 9/2014 | Underwood | |
| 8,973,164 | B2 * | 3/2015 | Hines | D02G 3/047 2/81 |
| 9,364,694 | B2 | 6/2016 | Underwood | |
| 9,370,212 | B2 | 6/2016 | Zhu | |
| 9,386,816 | B2 | 7/2016 | Underwood | |
| 9,409,378 | B2 | 8/2016 | Shiels | |
| 9,732,446 | B2 | 8/2017 | Favier | |
| 9,878,185 | B2 | 1/2018 | Underwood | |
| 9,913,504 | B2 | 3/2018 | Levit | |
| 10,316,438 | B2 | 6/2019 | Lipscomb | |
| 10,385,481 | B2 | 8/2019 | Underwood | |
| 10,405,594 | B2 | 9/2019 | Underwood | |
| 10,414,921 | B1 * | 9/2019 | Dehni | C08G 18/7664 |
| 10,433,593 | B1 | 10/2019 | Diianni | |
| 10,704,169 | B2 | 7/2020 | Habicht | |
| 10,870,932 | B2 * | 12/2020 | Stanhope | D03D 15/233 |
| 2005/0186875 | A1 | 8/2005 | Lilani | |
| 2006/0089069 | A1 | 4/2006 | Allen, II | |
| 2007/0095559 | A1 | 5/2007 | Muessig | |
| 2007/0248814 | A1 | 10/2007 | Mussig | |
| 2008/0086798 | A1 | 4/2008 | Allen, II | |
| 2009/0188017 | A1 | 7/2009 | Kruse | |
| 2011/0138523 | A1 | 6/2011 | Layson, Jr. | |
| 2011/0275267 | A1 | 11/2011 | Smith | |
| 2012/0183747 | A1 | 7/2012 | Bader | |
| 2012/0244772 | A1 | 9/2012 | Elder | |
| 2012/0270456 | A1 | 10/2012 | Gstettner | |
| 2014/0187113 | A1 * | 7/2014 | Hines, Jr. | D04H 1/43835 428/221 |
| 2014/0201960 | A1 | 7/2014 | Smith | |
| 2015/0104594 | A1 * | 4/2015 | Kwint | G02B 6/4429 428/221 |
| 2015/0191856 | A1 * | 7/2015 | Hines | D02G 3/047 428/221 |

(Continued)

FOREIGN PATENT DOCUMENTS

| | | | |
|---|---|---|---|
| EP | 0982378 | A4 | 10/2007 |
| IN | 280141 | B | 2/2017 |

(Continued)

*Primary Examiner* — Robert H Muromoto, Jr.
(74) *Attorney, Agent, or Firm* — Cheryl J. Brickey

(57) ABSTRACT

A woven fire-resistant fabric that contains a plurality of warp yarns in the warp direction of the woven fire-resistant fabric and a plurality of weft yarns in the weft direction of the woven fire-resistant fabric. The warp direction and weft direction are approximately perpendicular. At least a portion of the warp or weft yarns comprise a blend of solution dyed meta-aramid fibers and solution dyed para-aramid fibers. The para-aramid fibers contain a co-polymer being poly (diphenylether-co-para-phenylenediamine-terephthaloyldi-chloride) and the para-aramid fibers have a carbon black loading of greater than 1.0% by weight of the para-aramid fibers.

20 Claims, No Drawings

(56) References Cited

U.S. PATENT DOCUMENTS

| | | | | |
|---|---|---|---|---|
| 2015/0203995 | A1 | 7/2015 | Adams | |
| 2016/0227858 | A1 | 8/2016 | Shiels | |
| 2016/0317847 | A1 | 11/2016 | Underwood | |
| 2017/0130372 | A1 | 5/2017 | Underwood | |
| 2017/0292210 | A1* | 10/2017 | Iwashita | D06M 15/53 |
| 2020/0071860 | A1 | 3/2020 | Underwood | |
| 2020/0181865 | A1* | 6/2020 | Coutts | F16L 55/1651 |
| 2020/0354858 | A1* | 11/2020 | Tonosaki | D03D 15/283 |
| 2020/0360735 | A1 | 11/2020 | Cantin | |
| 2020/0398523 | A1 | 12/2020 | Gerhardt | |
| 2021/0172098 | A1 | 6/2021 | Dunn | |
| 2022/0364274 | A1 | 11/2022 | Stanhope | |
| 2023/0228011 | A1* | 7/2023 | Martin | D02G 3/32 139/421 |

FOREIGN PATENT DOCUMENTS

| | | |
|---|---|---|
| WO | 2001064985 | 9/2001 |
| WO | 2003016604 | 2/2003 |
| WO | 2003104538 | 12/2003 |
| WO | 2003104539 | 12/2003 |
| WO | 2004023909 | 3/2004 |
| WO | 2004067822 | 8/2004 |
| WO | 2006049626 | 5/2006 |
| WO | 2006113351 | 10/2006 |
| WO | 2009026478 | 2/2009 |
| WO | 2010043694 | 4/2010 |
| WO | 2011057073 | 5/2011 |
| WO | 2011100202 | 8/2011 |
| WO | 2013032563 | 3/2013 |
| WO | 2014051936 | 4/2014 |
| WO | 2015004432 | 1/2015 |
| WO | 2015134732 | 9/2015 |
| WO | 2016033593 | 3/2016 |
| WO | 2016114829 | 7/2016 |
| WO | 2020257036 | 12/2020 |
| WO | 2021009502 | 1/2021 |
| WO | 2021113712 | 6/2021 |

* cited by examiner

FIRE-RESISTANT TEXTILE

TECHNICAL FIELD OF THE INVENTION

This application relates to woven textile materials containing blends of meta-aramid and para-aramid with enhanced color stability when exposed to UV radiation and to repeated launderings.

BACKGROUND

Firefighters rely on turnout gear to help protect them from dangers they face on the job. Many factors work together to create a thorough turnout system that safeguards firefighters. The three components of turnout gear (referred to as the three-layer composite) work as a complete system. The three layers of structural turnout gear-outer shell, moisture barrier, and thermal liner-work together as a system to provide ongoing protection against thermal and environmental threats. The outer shell is the first line of defense, providing direct protection from fire and reducing heat transfer. It is also the most durable layer of fabric and helps ensure the gear remains intact.

Firefighter turnout gear (outer shell) with improved wash durability and lightfastness, while maintaining physical properties and protection levels, is greatly valued by the market. Firefighter turnout gear is very costly, and current available solutions have significant color change issues after extended use. The market desires an outer shell material with better appearance after laundering and UV exposure without sacrificing other properties. The main culprit causing these issues is the para-aramid fiber which is used in outer shells for both thermal protection and strength. Typically, these black outer shells contain as much as 60% para-aramid. Black para-aramid fibers lose their color significantly after washing and also after UV exposure. Outer shells with this high para-aramid content also lose significant strength after UV exposure. It would be preferable to have a textile that kept its deep, black color for a long time to increase the lifetime of the fabric and garment.

BRIEF SUMMARY OF THE INVENTION

The invention relates to a woven fire-resistant fabric that contains a plurality of warp yarns in the warp direction of the woven fire-resistant fabric and a plurality of weft yarns in the weft direction of the woven fire-resistant fabric. The warp direction and weft direction are approximately perpendicular. At least a portion of the warp or weft yarns comprise a blend of solution dyed meta-aramid fibers and solution dyed para-aramid fibers. The para-aramid fibers contain a co-polymer of diphenylether and para-phenylenediamine-terephthaloyldichloride and the para-aramid fibers have a carbon black loading of greater than 1.0% by weight of the para-aramid fibers.

DETAILED DESCRIPTION OF THE INVENTION

Garments made of fire-resistant textiles such as for fire fighters need to protect the wearer and look as new as possible as long as possible. When the garment prematurely fades, there is sometimes a question that as the aesthetics fade, so does the protection that the garment offers.

The preferred textile is a woven textile, but the invention is not limited to just woven fabrics. The textile may also be a knit or a non-woven. Preferably, the textile is provided in a woven construction, such as a plain weave, basket weave, twill weave, satin weave, or sateen weave. Suitable plain weaves include, but are not limited to, ripstop weaves produced by incorporating, at regular intervals, extra yarns or reinforcement yarns in the warp, fill, or both the warp and fill of the textile material during formation. Suitable twill weaves include both warp-faced and fill-faced twill weaves, such as 2/1, 3/1, 3/2, 4/1, 1/2, 1/3, or 1/4 twill weaves. In certain embodiments of the invention, such as when the textile material is formed from two or more pluralities or different types of yarns, the yarns are disposed in a patternwise arrangement in which one of the yarns is predominantly disposed on one surface of the textile material. In other words, one surface of the textile material is predominantly formed by one yarn type. In one preferred embodiment, the woven textile is a ripstop twill.

In the woven fire-resistant textile, there is a warp direction, also referred to as the machine direction and a weft direction, also referred to as the cross-machine direction. The warp and the weft direction are generally perpendicular to one another.

The textile contains any suitable yarns. "Yarn", in this application, as used herein includes a monofilament elongated body, a multifilament elongated body, ribbon, strip, yarn, tape, fiber and the like. The textile may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval.

At least a portion of the yarns are preferably spun yarns which are staple fibers formed into yarns. In one embodiment, essentially all (meaning at least 98% by weight) of the yarns in the fire-resistant textile are spun yarns. Other embodiments are envisioned where the warp and fill yarns may be a combination of spun yarns and/or filament yarns.

Each yarn may be formed from a single material or a blend of multiple materials. The textile can be formed from a single plurality or type of yarn (e.g., the fabric can be formed solely from yarns comprising a blend of meta-aramid fibers and para-aramid fibers), or the textile can be formed from several pluralities or different types of yarns (e.g., the fabric can be formed from a first plurality of yarns comprising a blend of meta-aramid fibers and para-aramid fibers and a second plurality of yarns comprising another inherent flame-resistant fiber).

In one preferred embodiment, at least a portion (preferably at least a majority by weight) of the warp and/or weft yarns are spun yarns containing a blend of meta-aramid fibers and para-aramid fibers. In one preferred embodiment, essentially all (meaning at least 98% by weight) of the warp yarns are spun yarns containing a blend of meta-aramid fibers and para-aramid fibers. In another preferred embodiment, essentially all (meaning at least 98% by weight) of the weft yarns are spun yarns containing a blend of meta-aramid fibers and para-aramid fibers. In another preferred embodiment, essentially all (meaning at least 98% by weight) of the warp yarns and weft yarns are spun yarns containing a blend of meta-aramid fibers and para-aramid fibers. A meta-aramid fiber usually has the characteristic of having a high heatproof temperature and a high thermal shrinkage rate. Meanwhile, a para-aramid fiber usually has the characteristic of having a high heatproof temperature, a low thermal shrinkage rate, and high strength.

In the blends described above, all of the yarns within the textile may have the same ratio blends of meta-aramid and para-aramid fibers or the amounts of the different materials may differ between the warp and the weft or within the warp and/or weft in a pattern-wise arrangement. Preferably, the blended spun yarns contain between about 5 and 80% by weight, more preferably between about 30 and 70% by weight, more preferably between about 35 and 65% by weight, more preferably between about 40 and 60% by weight of meta-aramid fibers. Preferably, the blended spun yarns contain between about 5 and 80% by weight, more preferably between about 30 and 70% by weight, more preferably between about 35 and 65% by weight, more preferably between about 40 and 60% by weight of para-aramid fibers. In one preferred embodiment, the amount of meta-aramid fibers and the amount of para-aramid fibers (by weight) is approximately equal or in a ratio (by weight) of meta-aramid fibers to para-aramid fibers of between about 0.9:1 to 1:0.9. In some embodiments, there are small percentages (preferably less than about 10% by weight, more preferably less than about 5% by weight) of other fibers including anti-static fibers.

Preferably, the meta-aramid fibers and/or the para-aramid fibers are solution dyed. This means that the dyeing occurs to the fibers instead of dyeing the resultant yarns, textiles, or garments. This may be preferred as it is more environmental and has the ability to have the colorants better penetrate the fibers for more long-lasting color. In one embodiment, all of the meta and para-aramid fibers in the textile are colored black which is a standard color for fire fighters.

In one preferred embodiment, the black color is provided by a heterogenous carbon black pigment. In this sense, heterogeneous refers to the physical state difference between the pigment (solid) and the fiber solution (liquid). Para-aramid and meta-aramid fibers are produced by dissolving the polymer in a solvent and then drawing the liquid solution through a spinneret while removing the solvent. In this embodiment, the carbon black pigment is dispersed in the polymer solution prior to drawing the fiber. Carbon black additives are known to improve UV resistance and provide a deep black color even at low loadings, for example 0.5% by wt or less, or 0.4% by wt or less, or 0.3% by wt or less. One concern, known by those skilled in the art, related to heterogeneous additives, is the tendency for the additive to lower the overall physical properties of the fiber at higher loadings. The amount of additive that will cause adverse effects to the fiber properties can be influenced by the fiber diameter, the size of the additive particles, and the nature of the fiber polymer.

While not being bound to any particular theory, the inventors theorize that one particular para-aramid co-polymer poly (diphenylether-co-para-phenylenediamine-terephthaloyldichloride) is better able to retain its physical properties with higher heterogeneous additive loading that traditional para-aramid polymers (poly (para-phenylene terephthalamide)). For example, the carbon black additive loading can be greater than 0.7% by wt, or greater than 1.0% by wt, greater than 2% by wt, or greater than 4% by wt.

One disadvantage of para-aramid fibers is the tendency for these fibers to fibrillate. Fibrillation is a phenomenon that occurs when the polymer morphology structure of para-aramid fibers breaks apart during laundering, resulting in small fibrils rather than a coherent fiber. This causes an undesirable frosty appearance on the fabric surface. In the preferred embodiments, para-aramid co-polymer poly (diphenylether-co-para-phenylenediamine-terephthaloyldichloride) fibers are blended with meta-aramid fibers to obtain a balance between the higher strength and additive loading of the para-aramid co-polymer with the low fibrillation and lower cost of meta-aramid fibers.

In one embodiment, the woven fire-resistant textile further contains a water repellent finish which is fluorine free. "Fluorine free" is being defined in this application as containing less than about 0.01% by wt of fluorine in the water repellent finish. The water repellent finish can be applied to the fibers prior to spinning, the yarns prior to weaving, or preferably, to the fabric after fabric formation. The fluorine-free finish can comprise a variety of chemical classes including silicones, waxes, polyolefins, poly (vinyl chloride), poly (vinylidene chloride), alkyl-substituted acrylics, alkyl-substituted polyamides, or a combination of the above.

After the fire-resistant textile is made, it may be further process into a garment or other textile finished good. The fire-resistant textile may used for any articles of clothing, structures (such as tents and fabric coverings), camouflage to cover objects and more that may need fire-resistance. As a garment, the metalized textile may be used for any suitable garment including, but not limited to, pants, shirts, outerwear such as jackets, shoes, hats, balaclava, and ballistic vest covers, scarves, and belts. The textile and/or garment may be left in its coloration from the solution dyed yarns (preferably black in many applications) or may have additional colors printed or otherwise applied such as camouflage colorations.

Examples

The inventive flame-resistant textile is intended for use in protective apparel for fire-fighters and is tested according to the NFPA 1971 Standard (Standard on Protective Ensembles for Structural Fire Fighting and Proximity Fire Fighting).

Examples 1-5 were woven fabrics where the warp and fill yarns were all made from the same blend of fibers. The yarns were formed by blending fibers, creating a sliver, and utilizing vortex spinning to make 2-ply spun yarns. The example woven fabrics were woven in a 2×1 left hand (LH) ripstop twill (Riptwill) construction or as a ripstop plain weave and subsequently finished. The finished weight for each example fabric was approximately 7 oz/yd$^2$ (exact weights listed in Table 3).

All fabrics contained para-aramid, meta-aramid, and anti-stat fibers in the percentages (by weight) listed in table 1.

TABLE 1

Fiber blends for yarns of Examples 1-5

| | | EX. 1 | EX. 2 | EX. 3 | EX. 4 | EX. 5 |
|---|---|---|---|---|---|---|
| Para-aramid fibers | poly(para-phenylene terephthalamide) | 50% | 50% | 0% | 0% | 52.5% |
| | Poly(diphenylether-co-para-phenylenediamine-terephthaloyldichloride) | 0% | 0% | 50% | 50% | 0% |
| Meta-Aramid fibers | Poly(meta-phenylene isophthalamide) | 0% | 0% | 0% | 48% | 46.5% |
| | Polyamide-imide | 48% | 48% | 48% | 0% | 0% |
| Anti-stat fibers | Carbon-infused polyamide antistat | 2% | 2% | 2% | 2% | 1% |

Table 2 identifies the type of weave used in the example woven fabrics and the colorfastness of the example fabrics to laundering and to UV exposure. Colorfastness to launderings was measured through 50 launderings per AATCC 135-2018-1,V,Ai). Color readings of the laundered fabrics compared to the unwashed fabrics were generated using a spectrophotometer (HunterLab-MiniScan EX 4500). Color readings were completed at the following laundering intervals: 5, 10, 20, 30 and 50. Colorfastness to Light was measured through 120 hours exposure per TM16.3-2020, Test Method for Colorfastness to Light: Xenon-Arc. Color readings of the exposed fabrics compared to the unexposed fabrics were generated using a spectrophotometer (Hunter-Lab-MiniScan EX 4500). Color readings were completed at the following exposure intervals in hours: 24, 48, 72, 96 and 120.

TABLE 2

Weave, colorfastness to laundering and colorfastness to UV exposure

| WEAVE | EX. 1 RIPSTOP | EX. 2 2 × 1 LH RIPTWILL | EX. 3 2 × 1 LH RIPTWILL | EX. 4 2 × 1 LH RIPTWILL | EX. 5 RIPSTOP |
|---|---|---|---|---|---|
| COLORFASTNESS TO LAUNDERING-5X, 10X, 20X, 30X, 50X (AATCC 135-2018-1, V, Ai) | | | | | |
| COLOR CHANGE-5X | 0.9 | 1.0 | 0.6 | 0.9 | 0.5 |
| COLOR CHANGE-10X | 1.9 | 2.0 | 1.3 | 1.2 | 1.3 |
| COLOR CHANGE-20X | 4.0 | 3.2 | 1.8 | 1.9 | 3.5 |
| COLOR CHANGE-30X | 4.3 | 3.9 | 2.4 | 2.4 | 4.5 |
| COLOR CHANGE-50X | 5.0 | 4.0 | 2.6 | 2.3 | 6.0 |
| COLORFASTNESS TO UV EXPOSURE-24, 48, 72, 96, 120 HOURS (AATCC 16.3) | | | | | |
| COLOR CHANGE-24 | 0.5 | 0.7 | 0.8 | 0.5 | 2.7 |
| COLOR CHANGE-48 | 0.4 | 1.0 | 1.5 | 0.9 | 4.6 |
| COLOR CHANGE-72 | 0.9 | 1.1 | 1.2 | 1.3 | 6.2 |
| COLOR CHANGE-96 | 0.9 | 0.9 | 1.1 | 1.0 | 7.3 |
| COLOR CHANGE-120 | 0.9 | 1.2 | 1.3 | 1.5 | 8.5 |

The example fabrics were weighted and tested for tensile strength. The weights of the fabric examples were measured using ASTM D3776. Tensile strength was measured per ASTM D5034—as received and after 120 hours exposure per TM16.3-2020, Test Method for Colorfastness to Light: Xenon-Arc.

TABLE 3

Weight and tensile strength of example fabrics

| | EX. 1 | EX. 2 | EX. 3 | EX. 4 | EX. 5 |
|---|---|---|---|---|---|
| WEIGHT, osy | 7.5 | 7.3 | 7.6 | 7.4 | 8.1 |
| TENSILE, $lb_f$ – as received – warp × weft | 241 × 236 | 235 × 223 | 307 × 306 | 308 × 298 | 345 × 316 |
| TENSILE, $lb_f$ – after 120 hours UV exposure – warp × weft | 174 × 183 | 155 × 168 | 248 × 278 | 253 × 266 | 267 × 242 |
| TENSILE, % strength retention after 120 hours UV exposure (average warp + weft) | 74.9 | 70.3 | 85.9 | 85.7 | 77.0 |

As evidenced by results, Examples 3 and 4, which both contain a para-aramid co-polymer (poly [diphenylether-para-phenylenediamine-terephthaloyldichloride]) and have a carbon black loading of greater than 2.0% by wt of the para-aramid fiber, outperform the other examples (1, 2, and 5) for color retention after laundering and after UV exposure, while retaining more strength after UV exposure. Examples 3 and 4 have improved overall colorfastness to launderings when compared to Example 1, Example 2, and Example 5. Examples 3 and 4 have equal colorfastness to UV exposure when compared to Example 1 and Example 2 and improved overall colorfastness to UV exposure when compared to Example 5. Examples 3 and 4 have improved tensile strength retention when compared to Examples 1, 2, and 5.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein. All percentages listed in the application (specification and claims) are percentages by weight unless stated otherwise. The terms "about" and "approximately" are used in the application to designate an approximate number. Unless otherwise specified, the term "about" and "approximately" means within plus or minus 10% of that number. For example, if the number "about 10 mm" were written in the specification, this should be read as 9-11 mm.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A woven fire-resistant textile comprising:

a plurality of warp yarns in the warp direction of the woven fire-resistant textile, and a plurality of weft yarns in the weft direction of the woven fire-resistant textile, wherein the warp direction and weft direction are approximately perpendicular, wherein at least a portion of the warp or weft yarns comprise a blend of solution dyed meta-aramid fibers and solution dyed para-aramid fibers, wherein the para-aramid fibers comprise a co-polymer being poly (diphenylether-para-phenylenediamine-terephthaloyldichloride), wherein the para-aramid fibers have a carbon black loading of greater than 1.0% by weight of the para-aramid fibers.

2. The woven fire-resistant textile of claim 1, wherein the woven fire-resistant textile is in a ripstop twill weave pattern.

3. The woven fire-resistant textile of claim 1, wherein the blend further comprises antistatic fibers.

4. The woven fire-resistant textile of claim 1, wherein the antistatic fibers are in an amount of less than about 5% by weight of the blend.

5. The woven fire-resistant textile of claim 1, wherein the solution dyed meta-aramid fibers are in an amount of between about 35 and 65% by weight of the blend.

6. The woven fire-resistant textile of claim 1, wherein the solution dyed para-aramid fibers are in an amount of between about 35 and 65% by weight of the blend.

7. The woven fire-resistant textile of claim 1, wherein the woven fire-resistant textile further comprises a water repellent finish which is fluorine free, "fluorine free" being defined as containing less than about 0.01 ppm of fluorine in the finish.

8. The woven fire-resistant textile of claim 1, wherein the para-aramid fibers have carbon black loading of greater than 4.0% by weight of the para-aramid fibers.

9. The woven fire-resistant textile of claim 1, wherein at least a majority by weight of the warp and weft yarns comprise the blend of solution dyed meta-aramid fibers and solution dyed para-aramid fibers.

10. The woven fire-resistant textile of claim 1, wherein at least 98% by weight of the warp and weft yarns comprise the blend of solution dyed meta-aramid fibers and solution dyed para-aramid fibers.

11. A fire-resistant garment having a first side and a second side, wherein the first side of the garment forms the outmost surface of the garment, wherein the garment comprises a woven fire-resistant textile comprising:

a plurality of warp yarns in the warp direction of the woven fire-resistant textile, and a plurality of weft yarns in the weft direction of the woven fire-resistant textile, wherein the warp direction and weft direction are approximately perpendicular, wherein at least a portion of the warp or weft yarns comprise a blend of solution dyed meta-aramid fibers and solution dyed para-aramid fibers, wherein the para-aramid fibers comprise a co-polymer being poly (diphenylether-para-phenylenediamine-terephthaloyldichloride), wherein the para-aramid fibers have a carbon black loading of greater than 1.0% by weight of the para-aramid fibers.

12. The woven fire-resistant garment of claim 11, wherein the woven fire-resistant textile is in a ripstop twill weave pattern.

13. The woven fire-resistant garment of claim 11, wherein the blend further comprises antistatic fibers.

14. The woven fire-resistant garment of claim 11, wherein the antistatic fibers are in an amount of less than about 5% by weight of the blend.

15. The woven fire-resistant garment of claim 11, wherein the solution dyed meta-aramid fibers are in an amount of between about 35 and 65% by weight of the blend.

16. The woven fire-resistant garment of claim 11, wherein the solution dyed para-aramid fibers are in an amount of between about 35 and 65% by weight of the blend.

17. The woven fire-resistant garment of claim 11, wherein the woven fire-resistant textile further comprises a water repellent finish which is fluorine free, "fluorine free" being defined as containing less than about 0.01 ppm of fluorine in the finish.

18. The woven fire-resistant textile of claim 11, wherein the para-aramid fibers have carbon black loading of greater than 4.0% by weight of the para-aramid fibers.

19. The woven fire-resistant garment of claim 11, wherein at least a majority by weight of the warp and weft yarns comprise the blend of solution dyed meta-aramid fibers and solution dyed para-aramid fibers.

20. The woven fire-resistant garment of claim 11, wherein at least 98% by weight of the warp and weft yarns comprise the blend of solution dyed meta-aramid fibers and solution dyed para-aramid fibers.

* * * * *